United States Patent [19]

Kelly

[11] 4,362,079

[45] Dec. 7, 1982

[54] ACCENTUATOR PLATE FOR VIBRATING SOUNDBOARD IN STRINGED MUSICAL INSTRUMENTS

[75] Inventor: Charles J. Kelly, San Francisco, Calif.

[73] Assignee: Thomas L. Ribbecke, San Francisco, Calif. ; a part interest

[21] Appl. No.: 264,195

[22] Filed: May 15, 1981

[51] Int. Cl.[3] ..... G10D 3/02

[52] U.S. Cl. ..... 84/291

[58] Field of Search ..... 84/275, 291, 292, 294

[56] References Cited

U.S. PATENT DOCUMENTS

| | | | |
|---|---|---|---|
| 567,028 | 9/1896 | Hall | 84/291 |
| 1,361,182 | 12/1920 | Reams et al. | 84/291 |
| 1,807,746 | 6/1931 | Moor | 84/275 |
| 2,414,238 | 1/1947 | Osburn | 84/29 1 |
| 3,435,721 | 4/1969 | Dopera | 84/292 |

*Primary Examiner*—Lawrence R. Franklin

*Attorney, Agent, or Firm*—David B. Harrison

[57] ABSTRACT

An accentuator plate is mounted in an opening provided for that purpose in the top surface of the hollow body of a vibrating soundboard type of stringed musical instrument. The accentuator plate has an outward, generally convex contour, and it has an inside generally concave contour to provide the accentuator plate with a thin, dome-shaped geometry. The accentuator plate is preferably located adjacent the lowest note string and substantially behind the bridge of the musical instrument. The accentuator plate comprises at least five percent and not more than thirty percent of the total surface area of the top surface of the instrument's body.

6 Claims, 2 Drawing Figures

ACCENTUATOR PLATE FOR VIBRATING SOUNDBOARD IN STRINGED MUSICAL INSTRUMENTS

BACKGROUND OF THE INVENTION

The present invention relates to an accentuator plate in the soundboard of a stringed musical instrument, and more particularly it relates to a vibrating soundboard accentuator plate for improving the tonal qualities of a stringed musical instrument.

Stringed musical instruments have been known, played and enjoyed since antiquity. Such acoustical instruments are characterized by a body, usually hollow, a neck extending from the body in one direction, and one or more strings suspended under controllable tension from a bridge mechanically coupled to a soundboard of the body to a hub at the distant end of the neck. As the string is vibrated by plucking, strumming, bowing, etc., the vibrations thereby induced in the string are transmitted by the bridge to the soundboard. The hollow body collects and directs the sounds in a forward direction, usually through openings, such as the central port in front of the bridge of an acoustical guitar.

While stringed musical instruments have been refined and improved over the years, they have still been characterized by some drawbacks. Non-linear frequency response and flat tonal qualities have characterized all but the most expensive of instruments. Unacceptably low output amplitudes for the lower notes of the instrument's voice and lack of sustain are additional drawbacks of the instruments of the prior art. Thus, a need has arisen for an improvement in stringed musical instruments which increases the volume, which lengthens the sustain qualities, which accentuates the low notes or bass frequencies, which improves the sensation of stronger upper partials and which endows the instrument with a more brilliant and even "shimmering" sound quality across the entire range thereof.

A number of approaches were taken by previous workers. One is depicted in U.S. Pat. No. 4,031,798 to Sidner, issued June 28, 1977. Therein, the soundboard was made of separately joined circumferential sectors or wedges which converged upon the location of the bridge. Sidner correctly recognized that the conventional soundboard contributed its own resonances and mechanical vibratory characteristics to the instrument to "color" its tonal qualities. Sidner's proposed solution was to construct the soundboard of "radially/circumferentially anistrophic sheets" which meant sheets having more uniform sound transmitting properties than the conventional wooden soundboards having longitudinal grain. The readily apparent drawback of the Sidner approach is the difficulty of constructing the radial wedges and the plurality of concentric ring braces.

Another prior approach is found in U.S. Pat. No. 3,233,495 to Bernardi, issued Feb. 8, 1966. Therein, a removable resonator attachment fitted over the bridge and strings with the hope of improving tonal qualities of the stringed instrument. That approach was unsatisfactory because the forearm of the player would come into contact with the resonator plate during playing and absorb sounds that would otherwise have been radiated. In addition, as the resonator plate was removable and touched the soundboard only through a gasket, very little, if any alteration of the basic tonal qualities of the soundboard were achieved. A similar approach was described in U.S. Pat. No. 1,617,454 to Monaco, issued Feb. 15, 1927. Therein, a resonator plate covered the upper end of the guitar body, but it required special bracing and a tongued brace which traversed the resonator. Complex construction, and interference with the fingerboard were apparent drawbacks in that approach.

A further prior approach is discussed in U.S. Pat. No. 4,068,553 to Dopyera, issued Jan. 17, 1978. Therein, guitars marketed under the trademark "DOBRO" were improved upon by the addition of a second "speaker cone like" vibrator mechanically linked directly to the bridge of the instrument. Both resonators were synchronized to "pump" together to achieve a tonal quality said to be desirable for "bluegrass" style music. One drawback of the so-called "DOBRO" approach is the mechanical complexity such instruments require.

Other prior art approaches included other forms of resonators mechanically linked to the bridge of a stringed instrument. For example, in U.S. Pat. No. 3,353,433 to Webster, issued Nov. 21, 1967, a tuning fork depending downwardly into the soundbox was attached at its common end to a "floating" bridge. In U.S. Pat. No. 81,012 to Schleicher, issued Aug. 11, 1868, an angled tongue was mounted inside the soundbox from the bridge to a lower point opposite the sound opening. Exterior longitudinal bracing strips on the backside of the soundboard was said to improve tonal qualities in a stringed musical instrument in U.S. Pat. No. 4,104,945 to Bolin, issued Aug. 8, 1978. A moving coil linear transducer was provided within the soundbox to facilitate electronic amplification.

Shaping the backside of the soundboard into a paraboloid reflector was thought to improve tonal quality in a guitar in U.S. Pat. No. 4,178,827 to Mallory. Special bracing and fastening of the bridge thereto was also thought to play a part in that invention. A less radically curved backside was depicted in U.S. Pat. No. 3,474,697 to Kaman, issued Oct. 28, 1969. The same inventor also emphasized special interior bracing patterns to achieve superior tonal qualities in a guitar in U.S. Pat. No. 3,656,395, issued Apr. 18, 1972. All of these prior art approaches required special construction techniques for the intrument and did not readily lend themselves to conversion of existing instruments.

SUMMARY OF THE INVENTION

With the foregoing prior art approaches in mind, and being cognizant of the drawbacks and disadvantages thereof, a general object of the present invention is to provide a vibrating soundboard stringed musical instrument with improved tonal qualities including increased volume, increased sustain, greater bass note response, stronger upper partials, and increased overall brilliance and even "shimmering" sound qualities.

Another object of the present invention is to provide an accentuator plate in the front surface of the soundboard which interrupts the planar or slightly curved surface thereof in a way which reduces standing waves and disharmonic soundboard resonances.

A further object of the present invention is to provide a thin, dome-shaped accentuator plate in the front surface of the soundboard which increases the surface thereof and acts as a frontal sound disperser.

Yet another object of the present invention is to provide a thin, yet outwardly domed, kidney shaped accentuator plate which is inherently stiff without need for internal bracing and which, when placed in the soundboard of a stringed musical instrument greatly improves its tonal qualities.

A still further object of the present invention is to provide a thin, dome-shaped accentuator plate in the soundboard of a stringed musical instrument at a location adjacent to the string tuned to the lowest note to improve low or bass frequency response of the instrument.

One more object of the present invention is to provide a thin, dome-shaped accentuator plate as a simple modification and improvement to existing vibrating soundboard musical instruments without difficulties and with substantial improvement in tonal qualities thereof.

These objects are met by the accentuator plate of the present invention. The plate is mounted in an opening provided for that purpose in the top surface of the hollow soundboard of a stringed musical instrument. The plate has an outward generally convex contour and an inside generally concave contour to give it a thin dome-shaped geometry. The plate may also have a somewhat kidney-shaped major plane geometry. Between the dome shape projection and the kidney shape plan, the plate combines thinness with increased mechanical stiffness which minimizes standing waves and improves the tonal qualities of the instrument. To accentuate the bass response, the accentuator plate may be located adjacent to the string tuned to the lowest note and also adjacent to the bridge. Preferably, the accentuator plate comprises at least five percent and not more than thirty percent of the total surface area of the top surface of the instrument's body.

These and other objects, advantages and features will be apparent to those skilled in the stringed musical instrument design arts from a consideration of the following detailed description of a preferred embodiment, presented in conjunction with the accompanying drawing.

DETAILED DESCRIPTION OF A PREFERRED EMBODIMENT

Figure 1:
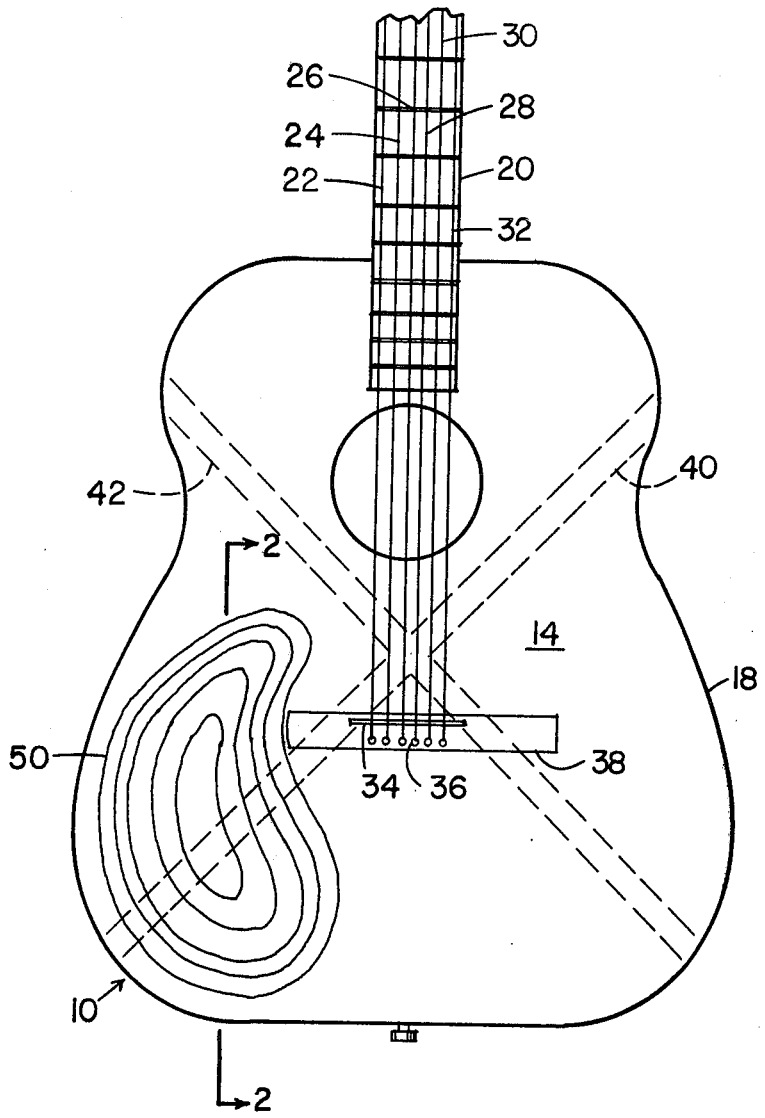
FIG. 1 is a plan view of a vibrating soundboard six string accoustical guitar of conventional design, with the neck broken off to save drawing room, with the interior cross bracing depicted in dashed lines, and with one preferred embodiment of the present invention emplaced in the top surface of the soundbox thereof.

One preferred embodiment of the accentuator plate of this invention is depicted in FIG. 1. Therein, an acoustical guitar 10 includes a hollow soundbox 12 having a topside 14, a backside 16, a continuous sidewall construction 18, and a neck 20 which is joined to the soundbox 12 at one end thereof along the longitudinal axis of the instrument 10. The instrument includes six strings 22, 24, 26, 28, 30, 32, with the string 22 being tuned to the lowest note and the string 32 being tuned to the highest tuning note of the instrument 10. The strings pass over an angled bridge 34 and are secured by pins 36 at a bridgeplate 38. Diagonal braces 40 and 42 are provided in conventional fashion to increase the stiffness of the topside 14 to minimize disharmonic resonances and to increase the sound projection of the instrument 10.

An accentuator plate 50 is glued into an opening provided for that purpose in the topside 14 with a suitable glue, such as cyanoacrylate adhesive (super glue). The accentuator 50 and opening in the topside 14 are so sized as to achieve a flush fit. This manner of installation facilitates unrestrained flexibility of the accentuator plate 50 and uninterrupted interaction between the plate 50 and the topside 14.

To provide enhancement of the bass notes of an acoustical flat top guitar, such as the guitar 10, the opening is provided in the bass frequency resonant area of the topside 14, as shown in FIG. 1. The opening in the topside 14 may be made with a rotating cutting tool, such as a router, which is mechanically linked by a pantograph to a pattern of the accentuator 50. In the case of modifying an existing guitar, the conventional cross brace 40 is left in place, and the bridgeplate 38 is routed away so that the accentuator plate 50 is next to, but not touching it.

As shown in FIG. 1, the accentuator plate 50 is somewhat kidney shaped and it occupies almost the entire lower left quarter of the soundbox 12. The "kidney shape" is not arbitrary. First, it fills up the low note quarterside of the soundbox 12 and thereby mirrors the flat side of the opposite high note quarterside. This shape provides increased stiffness, and increases the stiffness and thereby the tonal quality of the entire topside 14. This shape accomodates the bridgeplate 38 and facilitates a close mechanical couple to the low note string 22. Finally, this shape is pleasing in appearance.

The accentuator plate 50 is formed out of a solid block of Sitka spruce, and its grain is parallel with the longitudinal axis of the instrument. Different materials may be used depending upon the desired tonal qualities. Wood, fiberous plastics, metals or resin impregnated plastics may be used, with each material contributing its own particular tonal thumbprint to the instrument.

Figure 2:
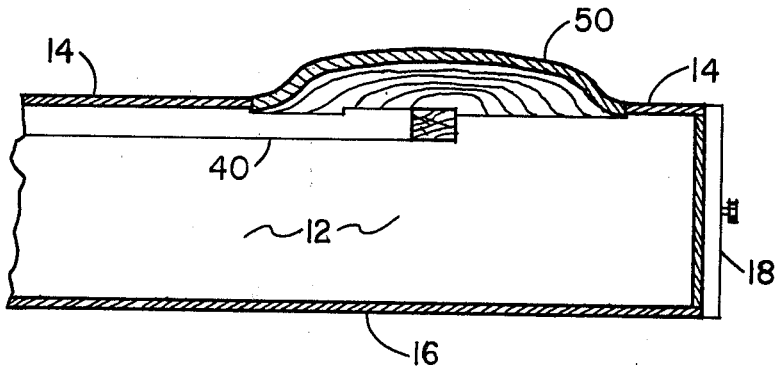
FIG. 2 is a side view in elevation and section, taken along line 2—2 of FIG. 1.

Referring now to FIG. 2, the accentuator plate 50 is depicted as a dome-shaped structure, which is thinned at its apex and thickened at its base. This arrangement provides suitable mechanical strength while enhancing the sound radiating qualities of the plate. The plate itself may be formed by use of a programmed cutting tool following a pattern. A router linked to the pattern by a pantograph works well.

While the accentuator plate 50 is depicted in this preferred embodiment as an addition to an existing guitar, such as a "TAKAMINE" brand guitar, model F-360-S, it may as well be added during original construction of the stringed instrument. Also, the accentuator plate will improve tonal qualities of all stringed, vibrating soundboard hollow body instruments. In the case of the TAKAMINE guitar, the results achieved by adding the accentuator plate 50 were striking: increased volume, increased sustain, accentuated bass notes, increased sensation of stronger upper partials and an overall "shimmering" tonal quality were noted.

The present invention provides in one instrument multiple tonal qualities. It integrates the best tonal and structural qualities of the conventional arched top guitar, also known as a "quick bass" with its clear articulation of notes, and of the flat top instruments, such as the accoustical guitar with its sustained notes of higher harmonic content. This invention applies to single course instruments such as six string guitars and also enhances double course instruments such as double tuned twelve stringed guitars.

To those skilled in the art of stringed musical instrument design, many changes in construction, including plural accentuator plates, and widely differing embodiments and shapes will suggest themselves without departing from the spirit and scope of the invention. The disclosures and the description herein are purely illustrative and are not intended to be in any sense limiting.

I claim:

1. In a vibrating soundboard stringed musical instrument characterized by a hollow body, a neck extending therefrom and defining the longitudinal axis of said instrument, and one or more strings extending under tension from the distant end of the neck to a bridge located on a top surface of the body opposite the neck, the improvement comprising an accentuator plate seated in an opening provided for that purpose in said top surface and secured at the periphery thereof to the edge of said top surface around said opening, said accentuator plate having an outward generally convex contour and having an inside generally concave contour, said plate and said opening being laterally offset in said body to one side of the longitudinal axis and closely adjacent said bridge.

2. In a vibrating soundboard stringed musical instrument characterized by a hollow body having a top surface, a neck extending therefrom along the longitudinal axis of said instrument, and one or more strings extending under tension from the distant end of the neck to a bridge located on said top surface, at least one thin, dome-shaped accentuator plate structure seated in an opening provided for that purpose in said top surface and secured at the periphery thereof to the edge of said top surface around said opening, said accentuator plate structure having an outward, generally convex contour and having an inside generally concave contour to provide said thin dome-shape, said plate structure and said opening being laterally offset in said body to one side of the longitudinal axis and closely adjacent said bridge.

3. In a vibrating soundboard stringed musical instrument characterized by a hollow body having a top surface, a neck extending therefrom along the longitudinal axis of said instrument, and one or more strings extending under tension from the distant end of the neck to a bridge located on said top surface, at least one thin, dome-shaped accentuator plate structure seated in an opening provided for that purpose in said top surface and secured at the periphery thereof to the edge of said top surface around said opening, said accentuator plate structure having an outward, generally convex contour and having an inside generally concave contour to provide said thin dome-shape, said plate structure and said opening being laterally offset in said body to one side of the longitudinal axis, closely adjacent to and substantially behind said bridge.

4. In a vibrating soundboard stringed musical instrument characterized by a hollow body having a top surface, a neck extending therefrom along the longitudinal axis of said instrument, and a plurality of strings extending under tension from the distant end of the neck to a bridge located on said top surface and tuned to different musical tones, from a low tone to a high tone in ascending arrangement, the improvement comprising a thin, dome-shaped accentuator plate structure seated in an opening provided for that purpose in said top surface and secured at the periphery thereof to the edge of said top surface around said opening, said accentuator plate structure having an outward, generally convex contour and having an inside generally concave contour to provide said thin dome-shape, said plate structure and said opening being laterally offset in said body to one side of the longitudinal axis, closely adjacent to and substantially behind said bridge and nearest said string tuned to said lowest musical tone.

5. In a vibrating soundboard stringed musical instrument characterized by a hollow body having a top surface, a neck extending therefrom along the longitudinal axis of said instrument, and one or more strings extending under tension from the distant end of the neck to a bridge located on said top surface, the improvement comprising a thin, dome-shaped accentuator plate structure seated in an opening provided for that purpose in said top surface and secured at the periphery thereof to the edge of said top surface around said opening, said accentuator plate structure having an outward, generally convex contour and having an inside generally concave contour to provide said thin dome-shape, said plate structure and said opening being laterally offset in said body to one side of the longitudinal axis, said structure comprising at least five percent and less than 30 percent of the total surface area of said top surface.

6. In a vibrating soundboard stringed musical instrument characterized by a hollow body having a top surface, a neck extending therefrom along the longitudinal axis of said instrument, and a plurality of strings extending under tension from the distant end of the neck to a bridge located on said top surface and tuned to different musical tones, from a low tone to a high tone in ascending arrangement, the improvement comprising a thin, domed, kidney-shaped accentuator plate structure seated in an opening provided for that purpose in said top surface and secured at the periphery thereof to the edge of said top surface around said opening, said accentuator plate structure having an outward, generally convex contour and having an inside generally concave contour to provide said thin dome-shape, said plate structure and said opening being laterally offset in said body to one side of the longitudinal axis, closely adjacent to, and the widened portion thereof being located substantially behind, said bridge and nearest said string tuned to said lowest musical tone.

* * * * *